US007931151B2

(12) United States Patent
McDonald et al.

(10) Patent No.: US 7,931,151 B2
(45) **Date of Patent: *Apr. 26, 2011**

(54) SUSPENSION PACKAGING SYSTEM

(76) Inventors: John McDonald, Fallbrook, CA (US); Frank Comerford, Laguna Niguel, CA (US); Myles Comerford, Rancho Santa Fe, CA (US)

( * ) Notice: Subject to any disclaimer, the term of this patent is extended or adjusted under 35 U.S.C. 154(b) by 19 days.

This patent is subject to a terminal disclaimer.

(21) Appl. No.: 11/943,514

(22) Filed: Nov. 20, 2007

(65) Prior Publication Data

US 2008/0067103 A1 Mar. 20, 2008

Related U.S. Application Data

(63) Continuation of application No. 11/022,135, filed on Dec. 23, 2004, now Pat. No. 7,296,681.

(51) Int. Cl.
*B65D 81/02* (2006.01)

(52) U.S. Cl. ..... 206/583; 206/591; 53/456

(58) Field of Classification Search ..... 206/521, 206/583, 584, 591, 592, 593, 594, 497, 495; 53/456

See application file for complete search history.

(56) References Cited

U.S. PATENT DOCUMENTS

| | | | | |
|---|---|---|---|---|
| 1,821,692 | A | | 9/1931 | Copeland |
| 2,161,128 | A | | 6/1939 | Boyle |
| 2,948,455 | A | * | 8/1960 | Frankenstein ..... 229/120.21 |
| 2,956,672 | A | | 10/1960 | Kirkpatrick |
| 3,047,137 | A | | 7/1962 | Kindseth |
| 3,326,410 | A | | 6/1967 | Asenbauer |
| 3,345,643 | A | | 10/1967 | Bradley |
| 3,853,220 | A | | 12/1974 | Luray |
| 3,905,474 | A | | 9/1975 | Haibara |
| 3,917,108 | A | | 11/1975 | Thurman |
| 4,077,518 | A | | 3/1978 | Kisslinger et al. |
| 4,155,453 | A | | 5/1979 | Ono |
| 4,606,460 | A | | 8/1986 | Luray |
| 4,852,743 | A | | 8/1989 | Ridgeway |
| 4,923,065 | A | | 5/1990 | Ridgeway |
| 5,046,659 | A | | 9/1991 | Warburton |
| 5,056,665 | A | | 10/1991 | Boecker et al. |

(Continued)

FOREIGN PATENT DOCUMENTS

DE 299 21 203 U1 2/2000

(Continued)

OTHER PUBLICATIONS

International Search Report dated Jul. 22, 2008 from PCT/US2008/57132, filed on Mar. 14, 2008, Applicants: John McDonald et al.—3 pages.

(Continued)

*Primary Examiner* — David T Fidei

(74) *Attorney, Agent, or Firm* — Knobbe Martens Olson & Bear LLP

(57) ABSTRACT

A suspension packaging system can include a foldable member configured to form a cavity as well as a suspension device for suspending an article to be packaged within the cavity. The suspension portion can include foldable portions configured to cooperate with a retention member having pockets. The foldable portions can fit into the pockets and then be folded so as to generate tension in the retention member. The entire device, with the exception of the retention member, can be made from a single piece of material, such as corrugated cardboard, which thus reduces waste and simplifies bulk distribution of such a suspension packaging system.

17 Claims, 10 Drawing Sheets

U.S. PATENT DOCUMENTS

| | | | | | |
|---|---|---|---|---|---|
| 5,071,009 | A | | 12/1991 | Ridgeway | |
| 5,076,436 | A | | 12/1991 | Bortolani et al. | |
| 5,080,497 | A | | 1/1992 | Peppiatt | |
| 5,183,159 | A | | 2/1993 | Hojnacki et al. | |
| 5,211,290 | A | | 5/1993 | Janus et al. | |
| 5,218,510 | A | | 6/1993 | Bradford | |
| 5,223,121 | A | | 6/1993 | Dickie et al. | |
| 5,226,542 | A | | 7/1993 | Boecker et al. | |
| 5,251,760 | A | * | 10/1993 | Smith et al. | 206/583 |
| 5,323,896 | A | | 6/1994 | Jones | |
| 5,372,257 | A | | 12/1994 | Beauchamp et al. | |
| 5,388,701 | A | | 2/1995 | Ridgeway | |
| 5,394,985 | A | | 3/1995 | Van Hest | |
| 5,405,000 | A | | 4/1995 | Hagedon et al. | |
| 5,492,223 | A | | 2/1996 | Boardman et al. | |
| 5,579,917 | A | | 12/1996 | Lofgren et al. | |
| 5,641,068 | A | | 6/1997 | Warner | |
| 5,669,506 | A | | 9/1997 | Lofgren et al. | |
| 5,676,245 | A | | 10/1997 | Jones | |
| 5,678,695 | A | | 10/1997 | Ridgeway | |
| 5,694,744 | A | | 12/1997 | Jones | |
| 5,722,541 | A | | 3/1998 | Lofgren et al. | |
| 5,738,218 | A | | 4/1998 | Gonzales | |
| 5,769,235 | A | | 6/1998 | Keach et al. | |
| 5,788,081 | A | | 8/1998 | Bates et al. | |
| 5,797,493 | A | | 8/1998 | Watson | |
| 5,803,267 | A | | 9/1998 | Tu et al. | |
| 5,823,348 | A | | 10/1998 | Phillips et al. | |
| 5,823,352 | A | | 10/1998 | Mena et al. | |
| 5,893,462 | A | | 4/1999 | Ridgeway | |
| 5,894,932 | A | | 4/1999 | Harding et al. | |
| 5,954,203 | A | | 9/1999 | Marconi | |
| 5,967,327 | A | | 10/1999 | Jones | |
| RE36,412 | E | | 11/1999 | Jones | |
| 5,975,307 | A | | 11/1999 | Harding et al. | |
| 5,988,387 | A | | 11/1999 | Staal et al. | |
| 6,006,917 | A | | 12/1999 | Loeffler | |
| 6,010,003 | A | | 1/2000 | Wilkinson | |
| 6,073,761 | A | | 6/2000 | Jones | |
| 6,079,563 | A | * | 6/2000 | Katchmazenski | 206/583 |
| 6,119,863 | A | | 9/2000 | Lofgren et al. | |
| 6,148,591 | A | | 11/2000 | Ridgeway et al. | |
| 6,158,589 | A | | 12/2000 | Smith et al. | |
| 6,206,194 | B1 | | 3/2001 | Beneroff et al. | |
| 6,223,901 | B1 | | 5/2001 | Lofgren et al. | |
| 6,289,655 | B1 | | 9/2001 | Ridgeway et al. | |
| 6,311,843 | B1 | | 11/2001 | Smith et al. | |
| 6,311,844 | B1 | | 11/2001 | Ridgeway et al. | |
| 6,398,412 | B2 | | 6/2002 | Wedi et al. | |
| 6,467,624 | B1 | | 10/2002 | Lofgren et al. | |
| 6,675,973 | B1 | | 1/2004 | McDonald et al. | |
| 6,899,229 | B2 | | 5/2005 | Dennison et al. | |
| 6,920,981 | B2 | | 7/2005 | Lofgren et al. | |
| 6,942,101 | B2 | | 9/2005 | Lofgren et al. | |
| 7,000,774 | B2 | | 2/2006 | Bryant | |
| 7,086,534 | B2 | | 8/2006 | Roesel et al. | |
| 7,150,356 | B2 | | 12/2006 | Lofgren et al. | |
| 7,290,662 | B2 | | 11/2007 | Lofgren et al. | |
| 7,296,681 | B2 | | 11/2007 | McDonald et al. | |
| 2001/0047950 | A1 | | 12/2001 | Beneroff et al. | |
| 2003/0034273 | A1 | | 2/2003 | Auclair | |
| 2003/0209463 | A1 | | 11/2003 | Halpin | |
| 2003/0234207 | A1 | | 12/2003 | Koike | |
| 2004/0108239 | A1 | | 6/2004 | McDonald et al. | |
| 2004/0178113 | A1 | | 9/2004 | Lofgren et al. | |
| 2005/0011807 | A1 | | 1/2005 | Dennison et al. | |
| 2005/0121354 | A1 | | 6/2005 | Gillis et al. | |
| 2006/0000743 | A1 | | 1/2006 | Lofgren et al. | |
| 2006/0042995 | A1 | | 3/2006 | McGrath et al. | |
| 2006/0102515 | A1 | | 5/2006 | McDonald et al. | |
| 2006/0138018 | A1 | | 6/2006 | McDonald et al. | |
| 2006/0213803 | A1 | | 9/2006 | Saitou et al. | |
| 2007/0080095 | A1 | | 4/2007 | McDonald et al. | |
| 2007/0251854 | A1 | | 11/2007 | McDonald et al. | |
| 2008/0067103 | A1 | | 3/2008 | McDonald et al. | |
| 2008/0099368 | A1 | | 5/2008 | McDonald et al. | |
| 2008/0110788 | A1 | | 5/2008 | Keiger | |
| 2008/0110794 | A1 | | 5/2008 | Anderson et al. | |
| 2008/0128316 | A1 | | 6/2008 | McDonald et al. | |
| 2008/0223750 | A1 | | 9/2008 | McDonald et al. | |
| 2009/0272667 | A1 | | 11/2009 | McDonald et al. | |

FOREIGN PATENT DOCUMENTS

| | | | |
|---|---|---|---|
| DE | 101 05 487 | A1 | 8/2002 |
| EP | 1 561 693 | B1 | 5/2008 |
| SU | 827346 | | 5/1981 |
| WO | 00/53499 | A2 | 9/2000 |

OTHER PUBLICATIONS

Written Opinion of International Searching Authority dated Jul. 22, 2008 from PCT/US2008/57132, filed on Mar. 14, 2008, Applicants: John McDonald et al.—5 pages.

International Search Report dated Sep. 30, 2008 from PCT/US2007/010010, filed on Apr. 26, 2007, Applicants: John McDonald et al.—5 pages.

Written Opinion of International Searching Authority dated Sep. 30, 2008 from PCT/US2007/010010, filed on Apr. 26, 2007, Applicants: John McDonald et al.—8 pages.

European Office Action dated Feb. 9, 2009 for European Application No. 05013333.9, filed Jun. 21, 2005, Applicants: John McDonald et al.—7 pages.

European Office Action dated Feb. 9, 2009 for European Application No. 05013375.0, filed Jun. 22, 2005, Applicants: John McDonald et al.—5 pages.

European Search Report dated Feb. 13, 2006 for European Application No. 05013333.9, filed Jun. 21, 2005, Applicants: John McDonald et al. (4 pages).

European Search Report dated Feb. 10, 2006 for European Application No. 05013375.0, filed Jun. 21, 2005, Applicants: John McDonald et al. (2 pages).

International Search Report dated May 23, 2008 from PCT/US2007/086532, filed on Dec. 5, 2007, Applicants: John McDonald et al. (2 pages).

Written Opinion of International Searching Authority dated May 23, 2008 from PCT/US2007/086532, filed on Dec. 5, 2007, Applicants: John McDonald et al.

* cited by examiner

SUSPENSION PACKAGING SYSTEM

PRIORITY INFORMATION

This application is a continuation application of U.S. patent application Ser. No. 11/022,135, titled SUSPENSION PACKAGING SYSTEM, filed Dec. 23, 2004, now U.S. Pat. No. 7,296,681, the entire contents of which is hereby expressly incorporated by reference.

BACKGROUND OF THE INVENTIONS

1. Field of the Inventions

The present inventions are directed to a packaging system. In particular, the present inventions are directed to a suspension packaging system that includes a stretchable retention member having at least one pocket.

2. Description of the Related Art

Protective packaging devices are often used to protect goods from shocks and impacts during shipping or transportation. For example, when transporting articles that are relatively fragile, it is often desirable to cushion the article inside a box to protect the article from a physical impact with the inner walls of the box that might be caused by shocks imparted to the box during loading, transit, and unloading.

In most cases, some additional structure is used to keep the article from moving uncontrollably within the box. Such additional structures include paper or plastic packing material, structured plastic foams, foam-filled cushions, and the like. Ideally, the article to be packaged is suspended within the box so as to be spaced from at least some of the walls of the box, thus protecting the article from other foreign objects which may impact or compromise the outer walls of the box.

U.S. Pat. No. 6,675,973 discloses a number of inventions directed to suspension packaging assemblies which incorporate frame members and one or more retention members. For example, many of the embodiments of the U.S. Pat. No. 6,675,973 include the use of a retention member formed of a resilient material. Additionally, some of the retention members include pockets at opposite ends thereof.

In several of the embodiments disclosed in the U.S. Pat. No. 6,675,973, free ends of the frame members are inserted into the pockets of the retention member. The free ends of the frame member are then bent, pivoted, or folded to generate the desired tension in the retention member. Because the retention member is made from a resilient material, the retention member can stretch and thus provide a mechanism for suspending an article to be packaged, for example, within a box.

SUMMARY OF THE INVENTION

One aspect of at least one of the inventions disclosed herein includes the realization that a single piece of material can be configured to provide both a container defining a cavity and means for tensioning a resilient member around an article to be packaged within the cavity. This provides several advantages. For example, by forming such a device out of a single piece of material, the device can be transported in an unfolded and flat state as a single piece, thereby simplifying the storage, transportation, and use of such devices.

For example, when a packaging system using a somewhat rigid material, such as cardboard, is formed of two separate pieces, the two separate pieces need to be gathered at the location at which the system is assembled. For example, many of the embodiments shown in the U.S. Pat. No. 6,675,973 include one assembly for tensioning a resilient member around an article to be packaged and a box or other container for housing the first assembly. In a retail setting using such a device, the establishment would order equal numbers of the support members and the corresponding containers, which may be delivered to the retail establishment in different boxes. Generally, equal numbers of the boxes and support members will be stocked by the retail establishment. Difficulties can arise in stocking two different components of a single assembly. For example, one may not realize that a supply of one component has run out, even though the supply of the other component has not. Thus, by constructing the system from a single piece of material, it is less likely that a stocking error will occur.

Thus, in accordance with one embodiment, a packaging kit for packaging an article and maintaining the article in a position spaced from a wall of a container, comprises a resilient member comprising a body portion and first and second pockets disposed at opposite ends of the body portion. A substantially rigid member comprises a container portion comprising a plurality of foldable portions configured to form at least a bottom and first, second, third, and forth walls extending from a periphery of the bottom. An article securing portion comprises at least a support portion and at least first and second pivotable portions configured to be pivotable relative to the support portion, the pivotable portions configured to be insertable into the first and second pockets, respectively. The article securing portion is pivotably connected to the container portion.

In accordance with another embodiment, a packaging container for packaging an article and maintaining the article in a position spaced from a wall of the container comprises a resilient member comprising a body portion and first and second pockets disposed at opposite ends of the body portion. A substantially rigid member comprises a container portion comprising means for forming at least a bottom and first, second, third, and forth walls extending from a periphery of the bottom. The container also includes means for securing an article with the resilient member under tension, wherein the means for securing is pivotably connected to the means for forming.

For purposes of summarizing the inventions and the advantages achieved over the prior art, certain objects and advantages of the inventions have been described hereinabove. Of course, it is to be understood that not necessarily all such objects or advantages may be achieved in accordance with any particular embodiment of the inventions. Thus, for example, those skilled in the art will recognize that the inventions may be embodied or carried out in a manner that achieves or optimizes one advantage or a group of advantages as taught herein without necessarily achieving other objects or advantages as may be taught or suggested herein.

All of these embodiments are intended to be within the scope of the inventions disclosed herein. These and other embodiments of the inventions will become readily apparent to those skilled in the art from the following detailed description of the preferred embodiments having reference to the attached figures, the inventions not being limited to any particular preferred embodiments disclosed.

BRIEF DESCRIPTION OF THE DRAWINGS

These and other features of the inventions are described below with reference to the drawings of several embodiments of the present packaging assemblies and kits which are intended to illustrate, but not to limit, the inventions. The drawings contain the following figures.

DETAILED DESCRIPTION OF THE PREFERRED EMBODIMENTS

An improved packaging system is disclosed herein. The packaging system includes an improved structure which provides new alternatives to known suspension packaging systems.

In the following detailed description, terms of orientation such as "upper," "lower," "longitudinal," "horizontal," "vertical," "lateral," "midpoint," and "end" are used here to simply the description in the context of the illustrated embodiments. Because other orientations are possible, however, the present inventions should not be limited to the illustrated orientations. Additionally, the term "suspension" is not intended to require that anything, such as an article to be packaged, is suspended above anything. Rather, the terms "suspended" as used herein, is only intended to reflect that such an article is held in a position spaced from another member, such as at least some of the walls of a container or box. Those skilled in the art will appreciate that other orientations of various components described herein are possible.

Figure 1:
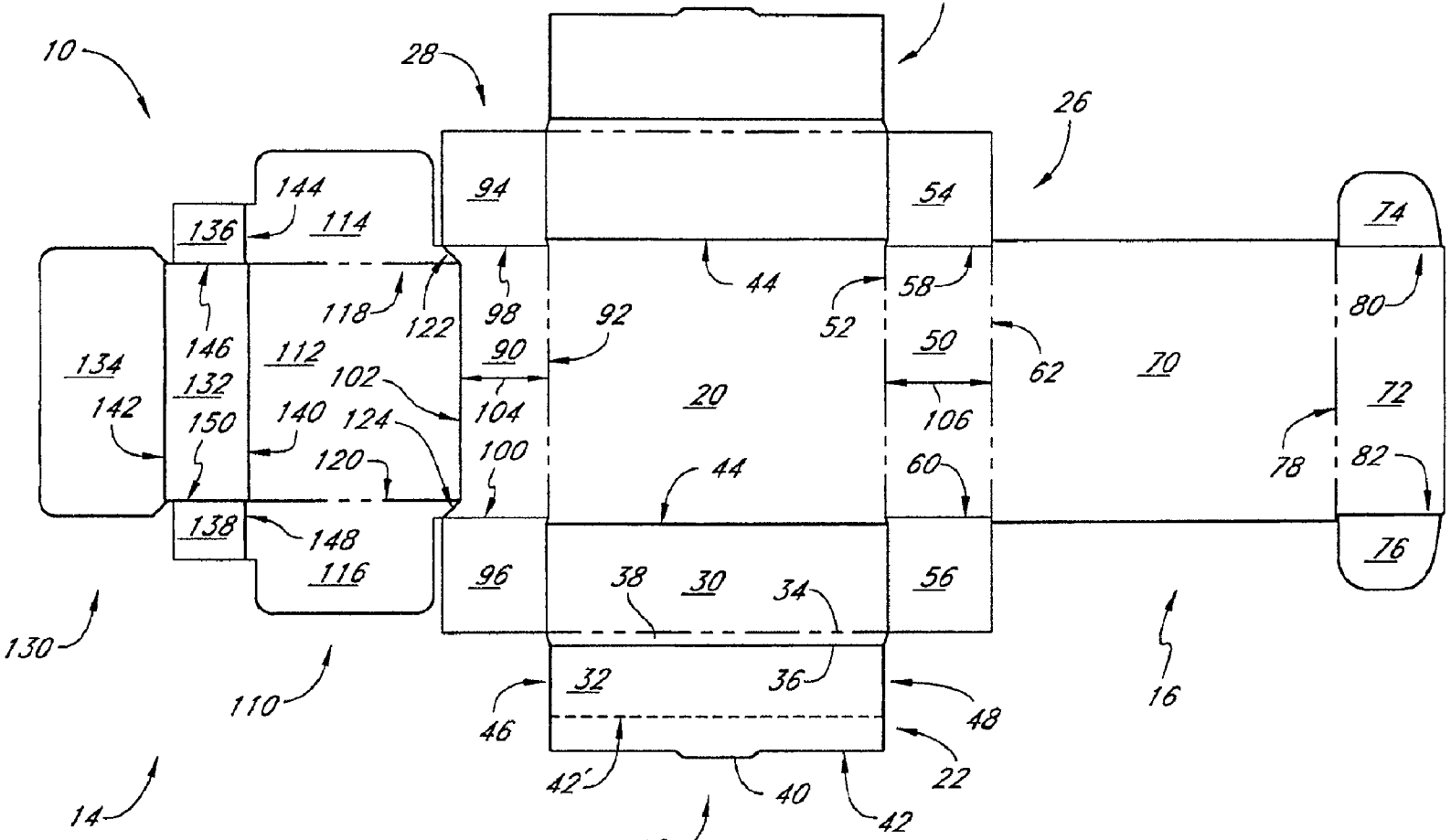
FIG. 1 is a plan view of a packaging member in an unfolded and unassembled state, the packaging member having foldable portions disposed around the periphery of a central portion.

With reference to FIG. 1, a foldable member 10 is illustrated therein in an unfolded state and is constructed in accordance with an embodiment. The foldable member 10 includes a container portion 12 and a suspension portion 14. The container portion 12 is configured to form a container having a cavity or a recess. The suspension portion 14 is configured to form a support and means for tensioning a resilient member for suspending an article to be packaged in a position spaced from at least some of the walls of the container portion 12. Optionally, the member 10 can include a lid portion 16 configured to form a lid for the container portion 12.

A further advantage is provided where, as illustrated in FIG. 1, the container portion 12 is connected to the suspension portion 14. As such, when manipulated into a folded state, the suspension portion 14 can be conveniently folded into the cavity of the container portion 12. Additionally, in this embodiment, both the container portion 12 and the suspension portion 14 can be formed from a single piece of material.

The member 10 can be constructed from various materials, including but without limitation, paper, cardboard, corrugated cardboard, plastic, and other appropriate materials. The chosen material for constructing the member 10 can be any substantially rigid but foldable material. It will be appreciated that, although denominated as rigid or substantially rigid, the chosen material would preferably have an amount of flexibility in the cases of extreme physical impact. In some embodiments, the material used to form the tray member 10 is a single wall corrugated C-flute cardboard.

In this embodiment, the member 10 includes a central base member 20. The designation as a "base member" does not impart any particular significance to the member 20. Rather, the base member 20, in this embodiment, simply forms a bottom or a top of the container, described in greater detail below. However, for ease of description, it is convenient to begin with the description of the base member 20.

The size of the base member 20 can be chosen by one of ordinary skill in the art to provide the desired amount of surface area of the bottom or top of the container formed by the member 10. In an exemplary but non-limiting embodiment, where the member 10 is intended to package a modem or a hard drive, the base member 20 can be about 10 inches square. However, this is merely an exemplary embodiment, and the base member 20 can have other dimensions for use in packaging modems or hard drives, or any other article that is to be packaged.

The container portion 12 can also include lateral wall portions 22, 24 and end wall portions 26, 28. Each of the lateral wall portions 22, 24 are configured to form a double wall portion when folded. For brevity, the construction of the lateral wall portion 22 will be described. However, it is to be understood that the lateral wall portion 24 also can include the same features.

The lateral wall portion 22 includes an outer panel 30 and an inner panel 32. Additionally, the lateral wall portion 22 can include at least one fold line defined between the inner panel 30 and the outer panel 32. In the illustrated embodiment, the lateral wall portion 22 includes an outer fold line 34 and an inner fold line 36.

The fold lines 34, 36 can be formed as perforations in the member 10, i.e., broken cut lines passing partially or completely through the material forming the member 10. In the alternative, or in addition, the fold lines can be crushed portions of the material forming the member 10. Of course, depending on the material used to construct the member 10, the fold lines can be formed as mechanical hinges, thinned portions, adhesive tape, or any other appropriate mechanical connection which would allow various portions of the tray member to be folded or rotated with respect to each other. These concepts apply to all the fold lines described herein, although this description will not be repeated with respect to the other fold lines described below.

In the illustrated embodiment, when the lateral wall portion 22 is folded upwardly and inwardly toward the base member 20, the inner panel 32 forms an inner wall of the container and the panel 30 forms an outer wall. The area between the fold lines 34, 36, identified generally by the reference numeral 38, will form an upper edge of the lateral wall portion 22.

The lateral wall portion 22 can also include means for securing the walls in place when folded. For example, in the illustrated embodiment, the inner panel 32 includes a projection 40 on its outermost edge 42. When the lateral wall portion 22 is completely folded, the projection 40 will rest against the base member 20 adjacent a fold line 44 defined at the boundary between the base portion 20 and the lateral wall portion 22.

The projection 40 is merely one type of configuration that can be provided for securing the lateral wall portion 22 in place. Optionally, lateral edges 46, 48 of the inner panel 32 can include projections similar to the projection 40. As such, the lateral edges 46, 48 will press against the end walls 28, 26, respectively, when in a folded state. Further, the base member 20 can include an aperture for receiving the projection 40.

In another embodiment, the inner panel 32 can be substantially narrower than the outer panel 30. For example, an optional outermost edge 42' is illustrated in FIG. 1 so as to illustrate another embodiment in which the inner panel 32 is significantly narrower than the outer panel 30. In this embodiment, it is preferable that the lateral edges 46, 48 are either enlarged or include projections for securing the inner panel 32.

This alternative provides a significant advantage because the inner panel 32 and the corresponding panel of the lateral wall portion 24 define the outermost extremes of one of the major dimensions of the member 10. Thus, by reducing the width of the panel 32 and the corresponding part of the lateral wall portion 42, the overall size and thus the waste of raw material used to form the member 10 can be reduced.

For example, as is well known in the arts using bulk cardboard, anything cut from cardboard begins as a large rectangular piece. The large rectangular piece must be at least as large, in every dimension, as the final product. Thus, by reducing the greatest dimensions of the finished piece, the size of the original raw material can be reduced, thus resulting in less wasted cardboard.

The end wall portion 26 can include a single wall panel 50 connected to the main panel along a fold line 52. The end wall portion 26 can also include corner flaps 54, 56, connected to the wall panel 50 along fold lines 58, 60. Optionally, the lid portion 16 can be connected to the end wall 50 along a fold line 62.

The lateral wall portion 26 is configured such that the panel 50 can be folded towards the base portion 20 along the fold line 52. Additionally, the corner flaps 54, 56 can be folded inwardly toward the panel 50, at about a right angle, for example, such that when the panel 50 is folded into an orientation being approximately perpendicular to the base portion 20, the corner flaps 54, 56 lie along or adjacent to the fold lines 44 between the lateral wall portions 22, 24 and the base portion 20. With the corner flaps 54, 56 in this orientation, the lateral wall portions 22, 24 can be folded over the corner flaps 54, 56. As such, for example, the corner flap 56 is sandwiched between the outer panel 30 and the outer panel 32.

The lid portion 16 can include a top panel portion 70 connected to the wall panel 50 along the fold line 62. The top panel 70 can be approximately the same size as the base panel 20. Additionally, the lid portion 16 can include a wall panel 72 and corner flaps 74, 76. The wall panel 72 is connected to the top panel 70 along a fold line 78. Additionally, the corner flaps 74, 76 are attached to the wall panel 72 along fold lines 80, 82.

The corner flaps 74, 76 are configured to be inserted into a space between the walls of the lateral wall portions 22, 24. For example, the corner flap 76 is configured to be inserted into a space between the outer wall 30 and the inner wall 32, described in greater detail below.

The end wall portion 22 can be configured substantially in the same manner as the end wall portion 26. Thus, the end wall portion 28 includes a wall panel 90 connected to the base portion 20 along a fold line 92. Additionally, the end wall portion 28 includes corner flaps 94, 96 attached to the wall panel 90 along fold lines 98, 100.

The suspension portion 14 is connected to the wall panel 90 along a fold line 102. The location of the fold line 102 defines a width of the panel 90. This width can be smaller than the width of the panel 50.

For example, the width of the panel 90 is identified by the reference numeral 104, and the width of the panel 50 is identified by the reference numeral 106. Generally, the width 106 of panel 50 is also the same as the width of the panel 30, the outer wall panel 30, and the corresponding outer wall of the lateral wall portion 24. Thus, the width 106 generally defines the maximum depth of the cavity formed by the container portion 12. The reduced width 104 of a portion of the wall 90 provides additional clearance for the suspension portion 14, illustrated in greater detail below with reference to FIG. 9.

The suspension portion 14 can also include a tensioning portion 110 that is configured to interact with a resilient member to suspend an article to be packaged within the cavity defined by the container portion 12. In the illustrated embodiment, the tensioning portion 110 includes a support panel 112 and at least one foldable portion. In some embodiments, the tensioning portion 110 can include two foldable portions 114, 116.

The foldable portions 114, 116 are connected to the support panel 112 along fold lines 118, 120. In some embodiments, the foldable portions 114, 116 are configured to fit into pockets defined in a resilient member and to tension the resilient member by being folded along the fold lines 118, 120, described in greater detail below with reference to FIGS. 5-7.

Optionally, extreme ends of the fold line 102, identified generally by the reference numerals 122, 124, can be cuts extending completely through the material forming the member 10. As such, the panel 112 can be folded more easily relative to the panel 90 along the fold line 102. Additionally, as illustrated in FIG. 1, the end portions 122, 124 of the fold line 102 are angled relative to the main portion of the fold line 102 to provide a contiguous connection to the corner panels 94, 96.

In this arrangement, the tensioning portion 110 can provide the dual functions of tensioning the resilient member so as to resiliently support an article to be packaged against the panel 112 and providing for a hinged folding movement of the article thus supported into the cavity defined by the container portion 12.

Optionally, the suspension portion 14 can further include a separator portion 130. The separator portion can be configured to define a separation, within the cavity defined by the container portion 12, and between the article to be packaged and a further open volume of space within the container.

In the illustrated embodiment, the separator portion 130 includes a wall panel 132, an anchor panel 134, and corner panels 136, 138. The wall panel 132 is connected to the support panel 112 along a fold line 140. The anchor panel 134 is connected to the wall panel 132 along fold line 142. The corner panel 136 is connected to both the foldable panel 114 and the wall panel 132 along fold lines 144, 146, respectively. Similarly, the corner panel 138 is connected to both the foldable portion 116 and the wall panel 132 along fold lines 148, 150.

As described in greater detail below, the wall panel 132, the anchor panel 134, and the corner panels 136, 138 can be folded relative to the tensioning portion 114 so as to define a separation between volumes of space within the cavity formed by the container portion 12.

Figure 2:
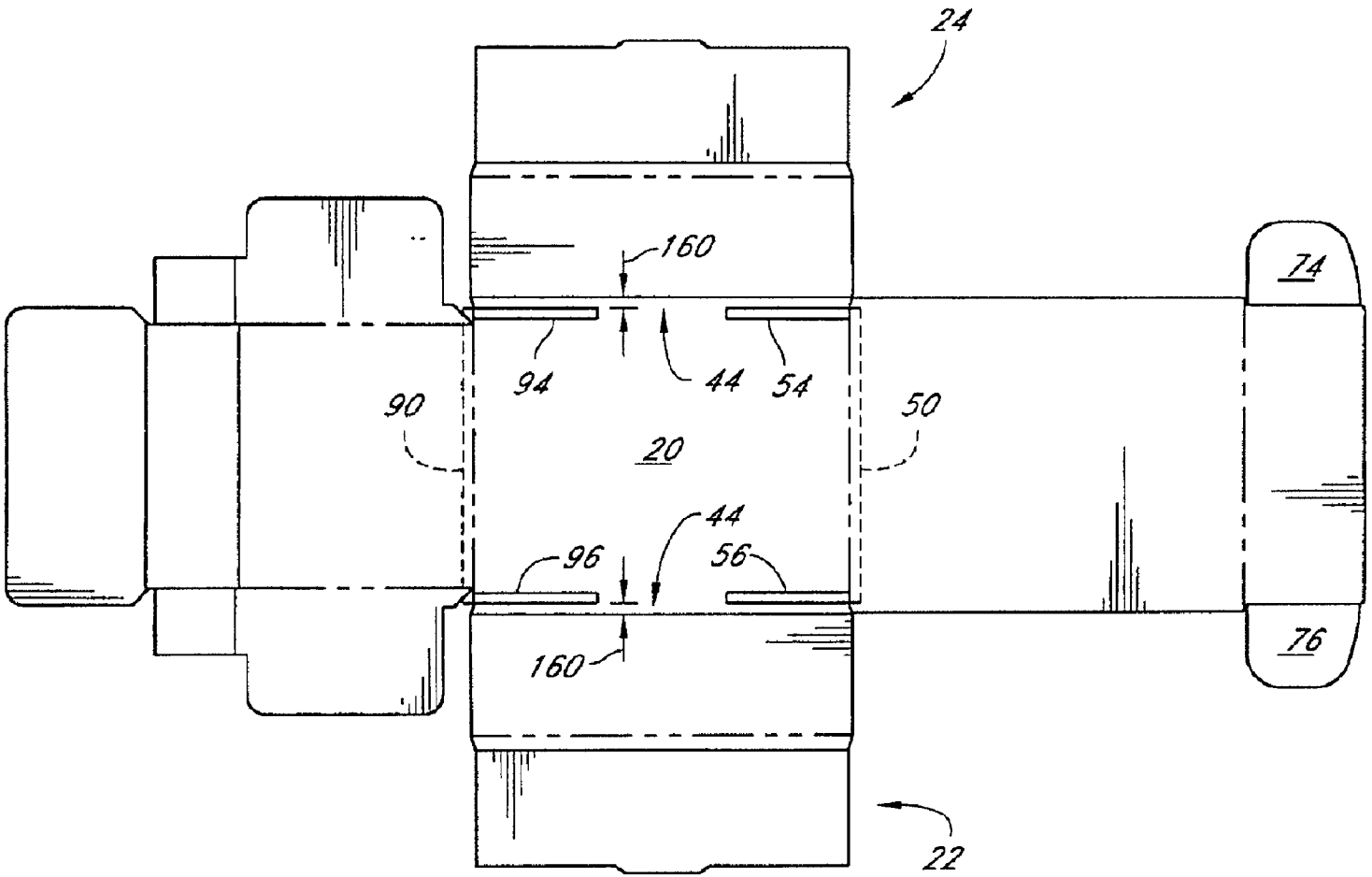
FIG. 2 is a plan view of the packaging member of FIG. 1 in a first partially folded state.

With reference to FIG. 2, in folding the container portion 12 so as to define a cavity, the corner panels 54, 56, 94, 96 can first be folded upwardly into a generally perpendicular orientation relative to the end walls 50, 90. Then, the walls 50, 90, along with the corner panels 54, 56, 94, 96 attached to and folded relative thereto, can be folded upwardly into a generally perpendicular orientation relative to the base 20. As shown in FIG. 2, folded as such, at least the corner panels 94, 96 define a small spacing between the corner panels 94, 96 and the fold line 44, the spacings identified generally by the reference numerals 160. The spacings 160 are configured to receive the corner panels 74, 76, described in greater detail below with reference to FIG. 10.

Figure 3:
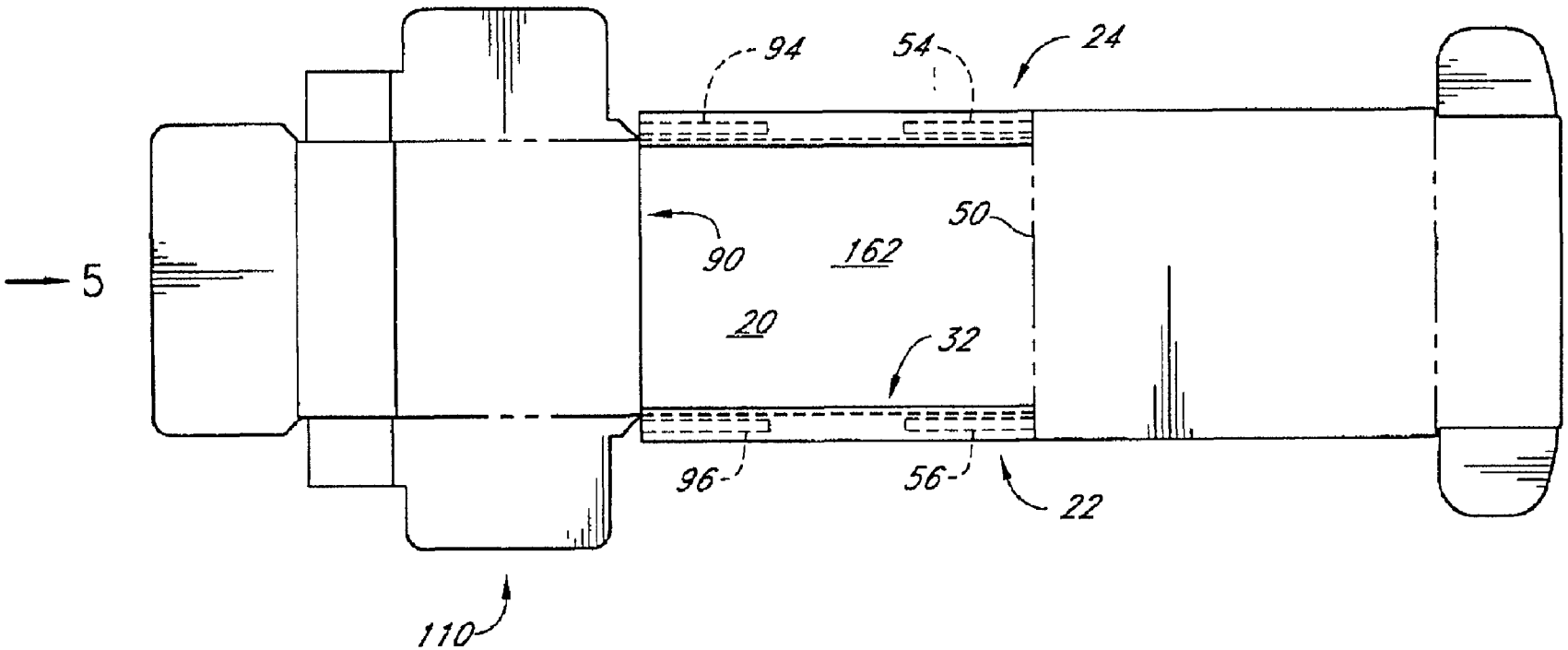
FIG. 3 is a plan view of the packaging member of FIG. 1 in a second partially folded state.

With reference to FIG. 3, the lateral wall portions 22 can then be folded so as to enclose the corner panels 54, 56, 94, 96, therein. For example, as shown in FIG. 3, the inner panel 32 and the corresponding panel of the lateral wall section 24, now form inner walls of a cavity 162. Similarly, the end walls 50, 90 form end walls of the cavity 162, with the base portion 20 forming the bottom thereof. Prior to or after the formation of the cavity 162 as such, an article to be packaged can be secured to the tensioning portion 110 with a resilient member.

Figure 4:
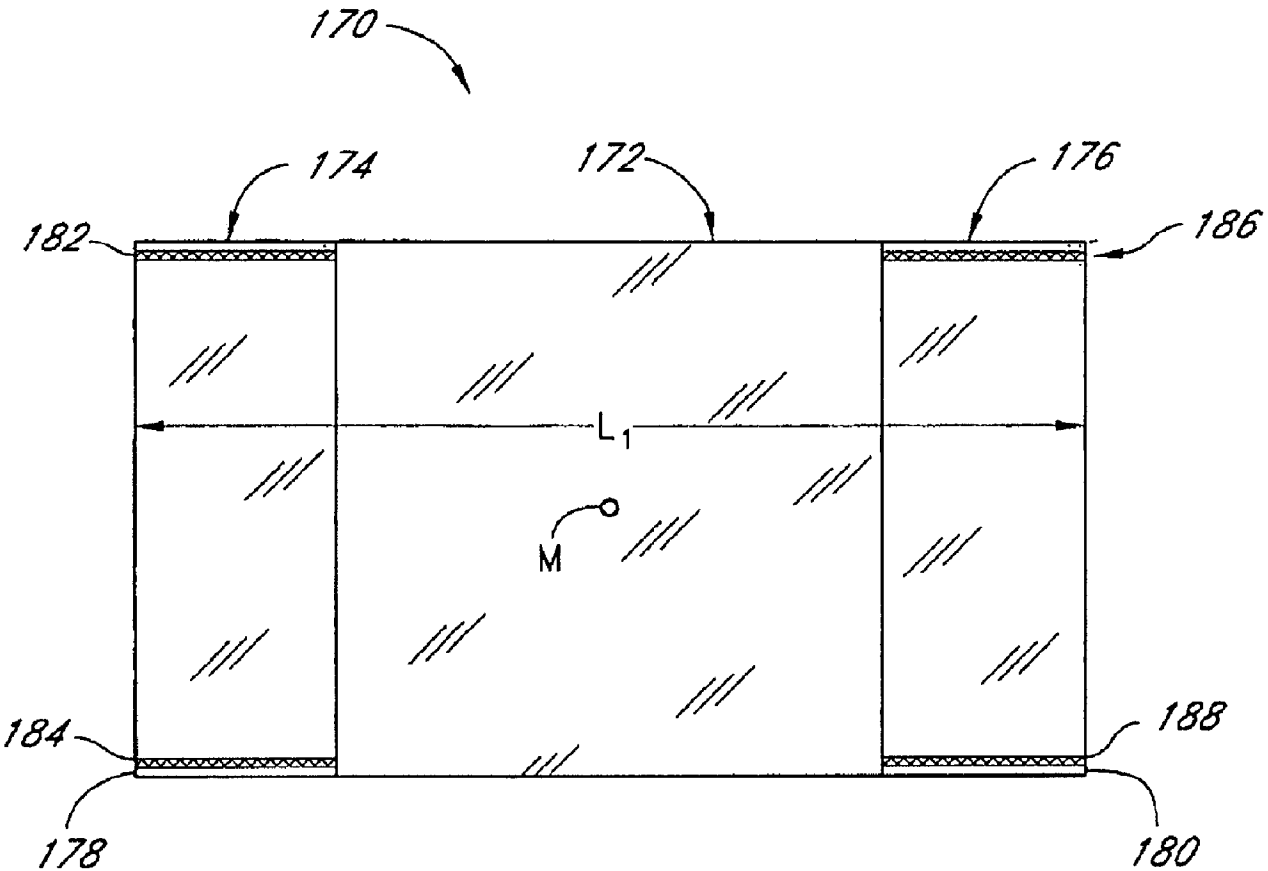
FIG. 4 is a plan view of a retention member having pockets.

FIG. 4 illustrates an exemplary embodiment of a resilient member 170 that can be used with the tensioning portion 110. The resilient member in the illustrated embodiment is identified as a retention member 170. The retention member 170 preferably is formed of a resilient body 172. For purposes of convenience for the following description, the body 172 is identified as having a mid point M positioned in the vicinity of the middle of the resilient body 172. The resilient body 172 also includes pockets 174, 176 at opposite ends thereof. In the illustrated embodiment, the retention member 170 is formed of a single piece of resilient material, and is sized to cooperate with the tensioning member 110 having the foldable portions 114, 116.

In the illustrated embodiment, the pockets 174, 176 are formed of folds 178, 180 formed in the resilient body 172 which have been attached (e.g., heat sealed) along lateral opposite edges thereof. In this embodiment, the heat sealing process forms the heat sealing lines 182, 184, 186, 188. The heat sealing lines 182, 184, 186, 188 can be continuous or formed of a plurality of heat sealed points.

One of ordinary skill in the art will appreciate that there are numerous methods for forming pockets in a resilient sheet material such as the resilient body 172. However, it has been found that heat sealing is particularly advantageous as it does not require expensive adhesives in the time consuming steps required for using such adhesives. However, such adhesives can be used if desired.

The retention member 170 has a length $L_1$ that is sized depending on the other devices with which the retention member 170 is to cooperate. Thus, the length $L_1$ can be sized such that when the retention member is in its final state, e.g., engaged with the folding portions 114, 116, it generates the desired tension for the corresponding application. Thus, the length $L_1$ will be smaller where a higher tension is desired and will be larger where a lower tension is desired. Additionally, the length $L_1$ might be different for different sized articles that are to be packed. One of ordinary skill in the art can determine the length $L_1$ for the corresponding application.

The retention member 170 can be formed of any resilient material. In some embodiments, the retention member 170 can be made of a polyethylene film. However, virtually any polymer, elastomer, or plastic film can be used to form the retention member 170. The density of the film can be varied to provide the desired retention characteristics such as overall strength, resiliency, and vibrational response. Preferably, the density of the retention member 170 is determined such that the retention member 170 is substantially resilient when used to package a desired article.

Figure 5:
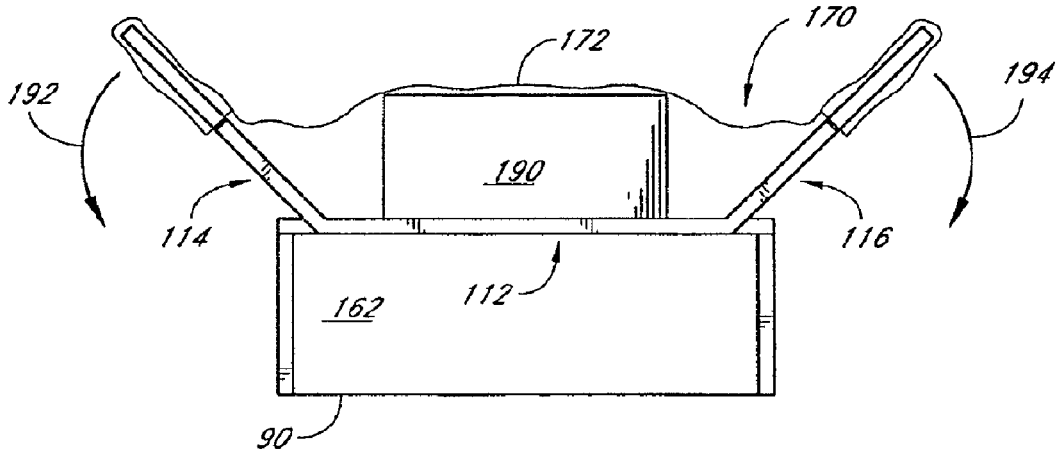
FIG. 5 is a front elevational view of the packaging member of FIG. 3 as viewed along the direction 5 shown in FIG. 3 and having the retention member of FIG. 4 engaged therewith.

With reference to FIG. 5, with the member 10 in the orientation described above with reference to FIG. 3, the retention member 170 can be engaged with the foldable portions 114, 116. For example, the pockets 174, 176 of the retention member 170 can be placed over portions of the foldable portions 114, 116. Additionally, an article to be packaged 190 can be disposed between the body portion 172 of the retention member 170 and the support panel 112. Then, the foldable portions 114, 116 can be folded downwardly (as viewed in FIG. 5) along the direction of arrows 192, 194, respectively, until the desired tension is achieved.

Figure 6:
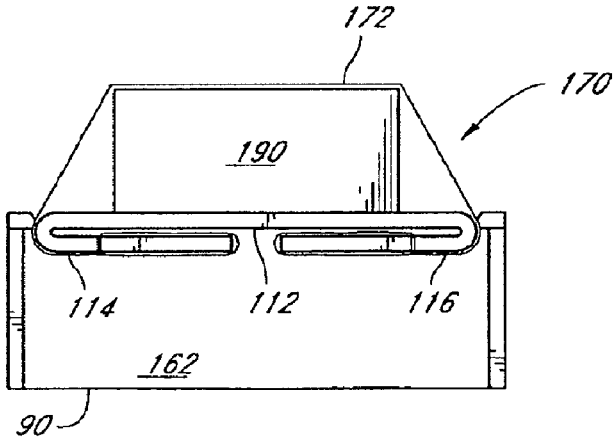
FIG. 6 is a front elevational view of the packaging member of FIG. 5 having portions thereof folded.

For example, as shown in FIG. 6, the foldable portions 114, 116 can be folded to their maximum limit until they lie against the support panel 112. Alternatively, the length $L_1$ of the retention member 170 can be sized such that the foldable portions 114, 116 generate the desired tension before they are folded against the support panel 112, thereby leaving a clearance between the foldable portions 114, 116 and the panel 112. This can provide additional cushioning for the article 190 between the foldable portions 114, 116 and a cover of the cavity 162.

Figure 7:
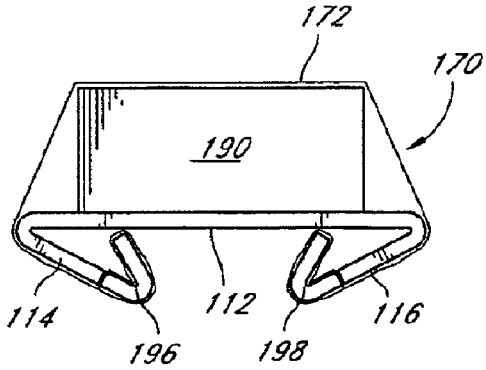
FIG. 7 illustrates a modification of the folds illustrated in FIG. 6.
Figure 7A:
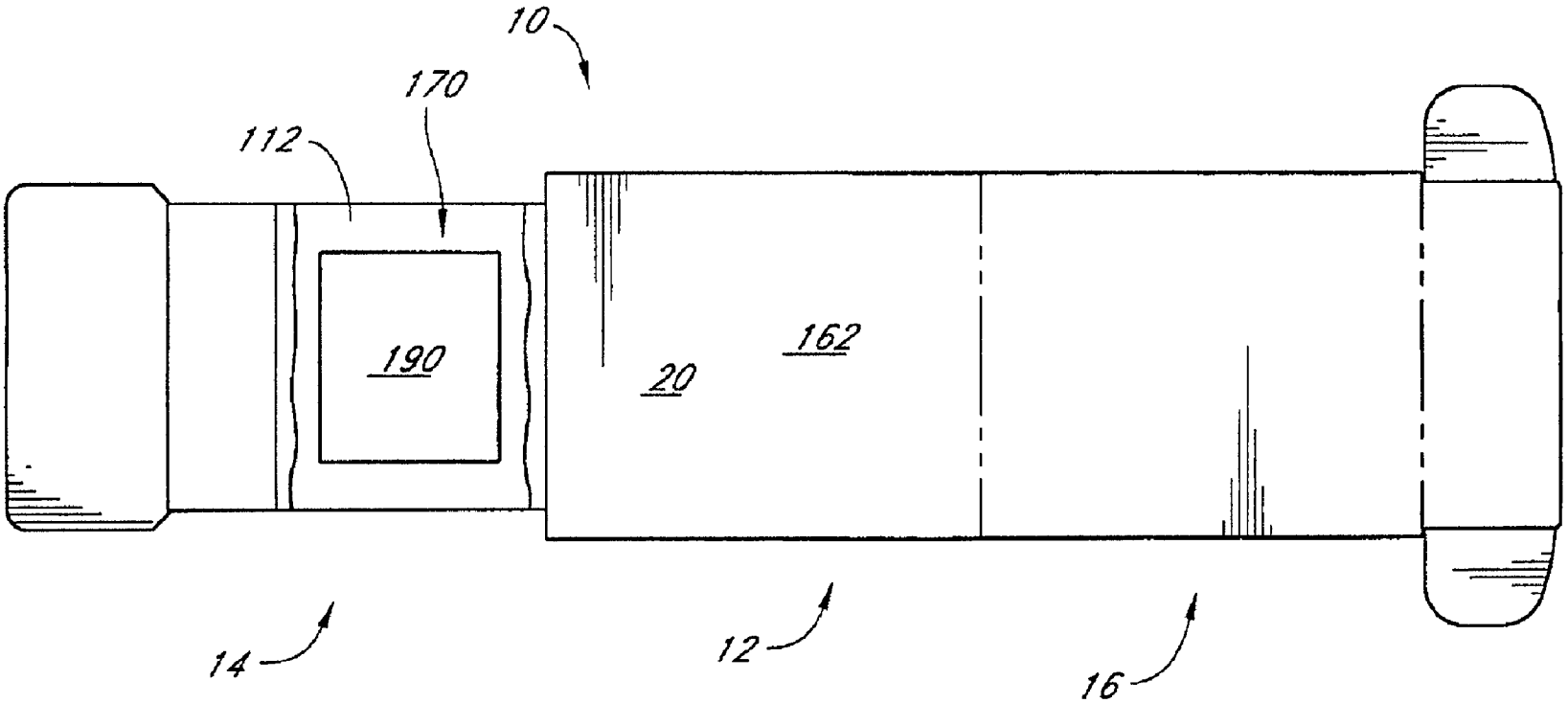
FIG. 7A is a plan view of the packaging member having been folded in the position illustrated in FIGS. 6 and 7.

With reference to FIG. 7, in some embodiments, the foldable portions 114, 116 can include additional fold lines identified generally by the reference numerals 196, 198. As such, the foldable portions 114, 116 can be further folded to thereby generate an additional shock absorbing structure beneath the panel 112. The function of this additional shock absorbing feature is described in greater detail below with reference to FIG. 11.

FIG. 7 illustrates a top plan view of the member 10 having the article to be packaged 190 secured to the panel 112 with the resilient retention member 170.

Figure 8:
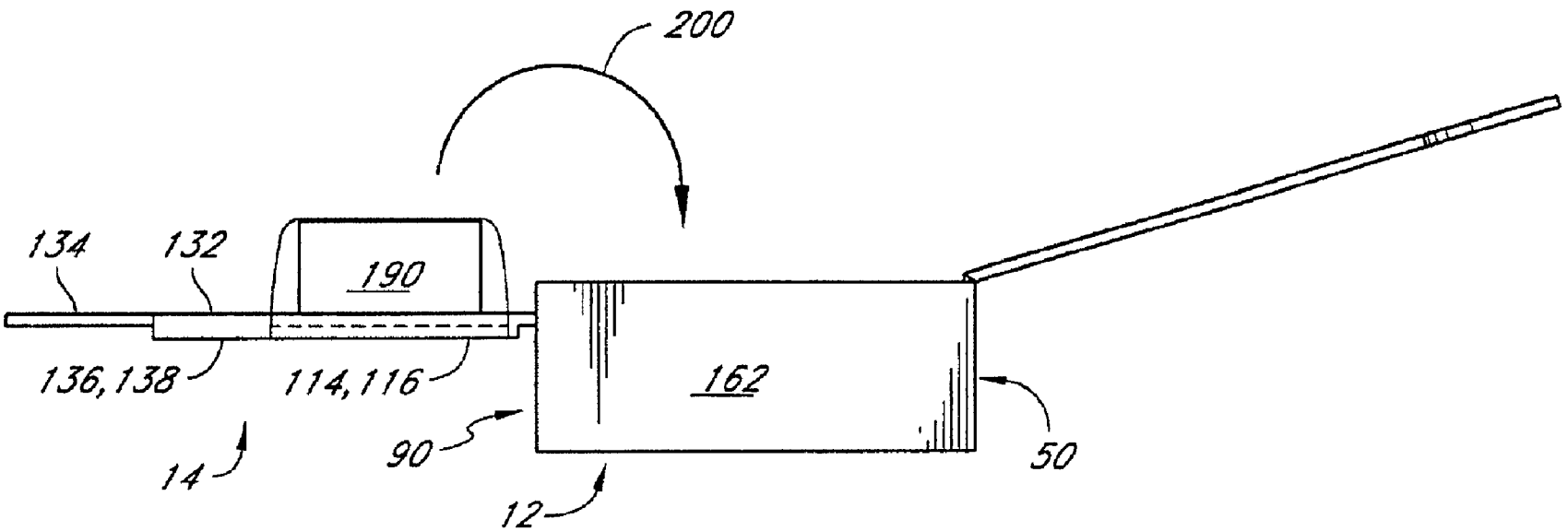
FIG. 8 is a side elevational view of the packaging member in the position illustrated in FIG. 7A.

With reference to FIG. 8, the suspension portion 14 can then be rotated relative to the container portion 12, in the direction identified by the arrow 200.

Figure 9:
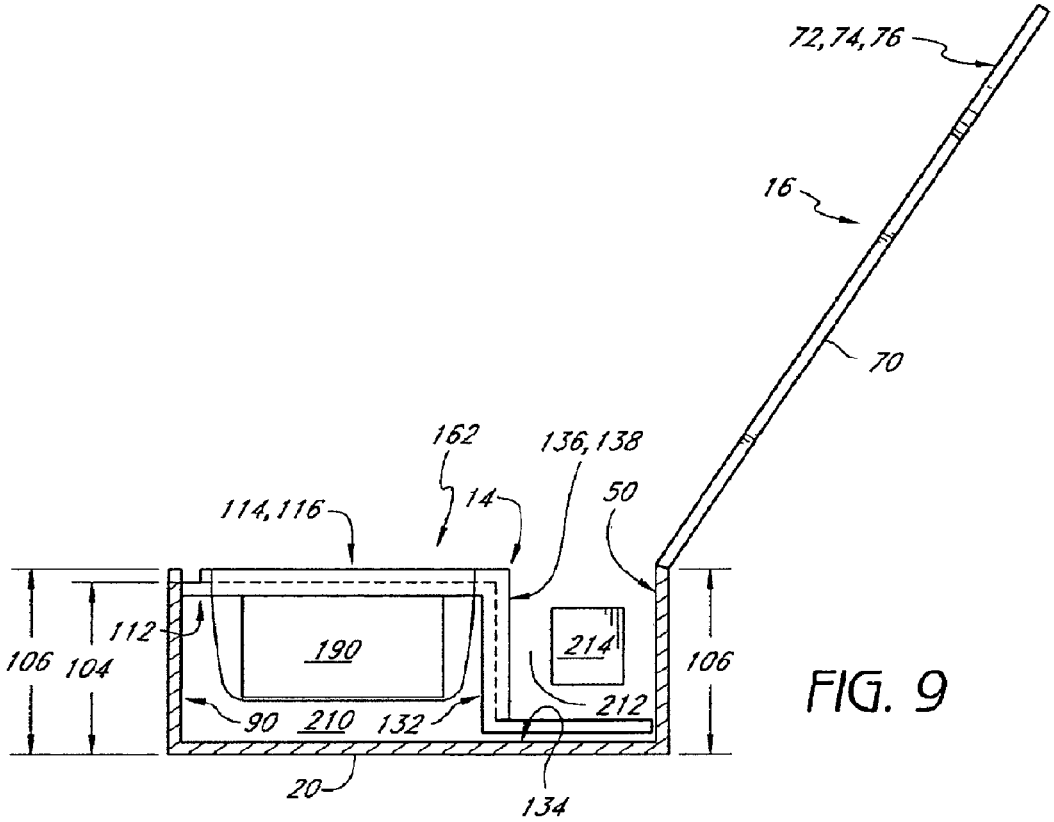
FIG. 9 is a partial cut-away side elevational view of the packaging member illustrated in FIG. 8, having been further folded such that the article to be packaged is disposed within the cavity of the container portion of the member.

FIG. 9 illustrates an orientation of the suspension portion 14 after having been folded in the direction of arrow 200. In this orientation, the face of the panel 112 contacting the article 190 faces inwardly toward the cavity 162. The foldable portions 114, 116 now face upwardly.

As noted above, the width 104 of the portion of the front wall 90 which connects to the suspension portion 14 along the fold line 102 is less than the width 106 defined by the wall 50. The difference between the widths 106, 104 allows the suspension portion 14 to fold slightly more deeply into the cavity 162, thereby providing space for the additional thickness created by the folding portions 114, 116 when in the position illustrated in FIG. 9.

The width 104 can be further decreased, in some embodiments, to provide additional clearance between the folding portions 114, 116 in the upper peripheral edge of the cavity 162 defined by the width 106. For example, as noted above, if it is desired to provide an additional shock absorbing effect by allowing the foldable portions 114, 116 to remain spaced from the support panel 112, the additional space required can be accommodated by making the width 104 smaller. As such, the suspension portion 14 can sit more deeply in the cavity 162, thereby allowing the foldable portions 114, 116 to remain spaced from the panel 112. Thus, when a lid is placed over the cavity 162 at the height defined by the width 106, the foldable portions 114, 116 can flex under the tension of the retention member 170 to absorb shocks and/or impacts made to a lid used to cover the upper opening of the cavity 162, such as the lid portion 116.

With continued reference to FIG. 9, it is to be noted that the separator portion 130 has also been folded to divide the internal cavity 162 into a suspension cavity 210 and an additional cavity 212. In the illustrated embodiment, the suspension cavity 210 serves to isolate the article 190 within the cavity 162. The additional cavity 212 can be used to store other items, such as, for example, but without limitation, articles that are not as sensitive as the article 190. In an illustrative but non-limiting embodiment, the article 190 can be a hard drive or a modem and the other article 214 disposed in the additional cavity 212 can be the power cord, data cable, and/or other items that are not as shock sensitive as the article 190.

In the illustrated embodiment, it is to be noted that the corner panels 138, 136 cooperate with the wall panel 132 to define a double wall divider between the cavity 210 and the cavity 212. However, this is merely an optional arrangement and the corner portions 136, 138 can be eliminated altogether. However, using the additional corner panels 136, 138 provides additional structural integrity to the suspension portion 14 and in particular, the retention of the folded shape of the suspension portion 14, as illustrated in FIG. 9. In this arrangement, the anchor panel 134 also aids in anchoring the position of the wall 132.

In some embodiments, the divider portion 130 can also include foldable portions similar to the foldable portions 114, 116 and a resilient member, similar to the retention member 170, for providing another suspension packaging arrangement in the cavity 212.

Figure 10:
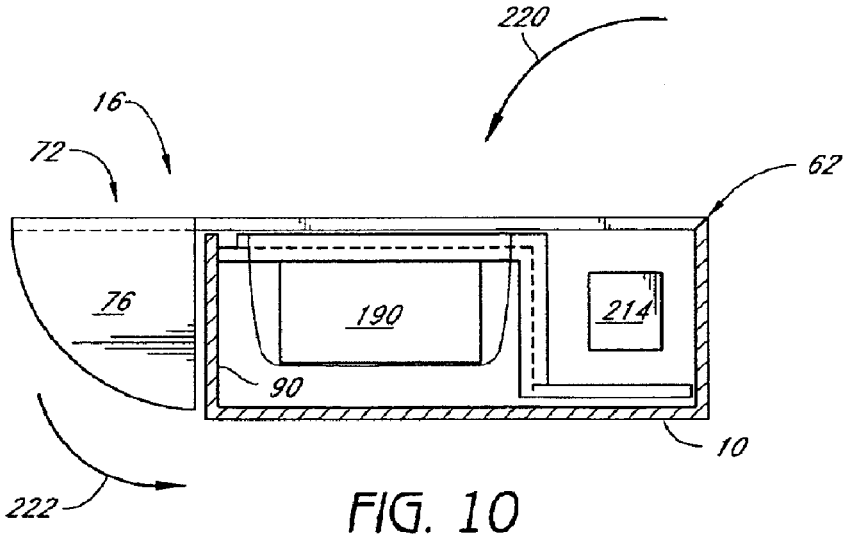
FIG. 10 is a partial cut-away and side elevational view of the packaging member of FIG. 9 with a lid portion having been folded over the container portion.

With reference to FIG. 10, the lid portion 16 has been folded about the fold line 62 along the direction identified by the reference numeral 220. Additionally, although not illustrated, the panels 74, 76 along with the wall panel 72 can be further rotated in the direction identified by arrow 222 such that the panels 74, 76 are inserted into the gaps 160 (FIG. 2), so as to secure the wall panel 72 against the wall 90.

In this arrangement, the member 10, which can be formed from a single piece of material, is used not only to define one or a plurality of internal cavities 162, 210, 212, but also to provide a suspension packaging arrangement using a tensioned resilient member as well as a lid. Thus, the member 10 can be shipped in the flat and unfolded state illustrated in FIG. 1, stacked in a tight fashion allowing a large number of members 10 to be transported to a user in high numbers and at low cost. Additionally, the retention members 170 can be provided in a roll form in high numbers and in a compact state.

Figure 11:
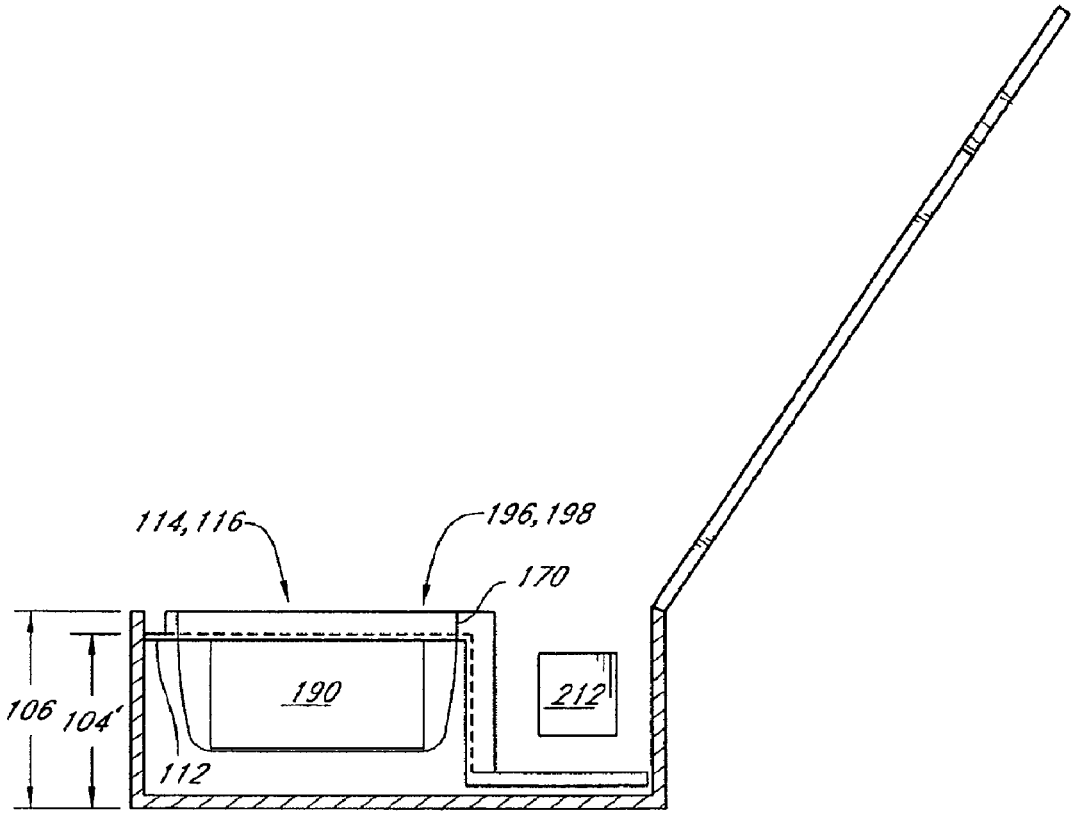
FIG. 11 is a side elevational and partial cut-away view of a modification of the packaging member having an optional folding arrangement.

FIG. 11 illustrates an arrangement in which the foldable portions 114, 116 are not folded completely against the support panel 112. Rather, the foldable portions 114, 116 are left to flex under the tension of the retention member 170 to provide a further shock absorbing function. Alternatively, FIG. 11 can be considered to represent the arrangement illustrate in FIG. 7 in which the foldable portions 114, 116 include the additional fold lines 196, 198 providing an additional and further shock absorbing structure.

In either of these arrangements, the width 104 has been reduced to a width 104' to thereby provide increased clearance for the optional arrangement of the foldable portions 114, 116.

Figure 12:
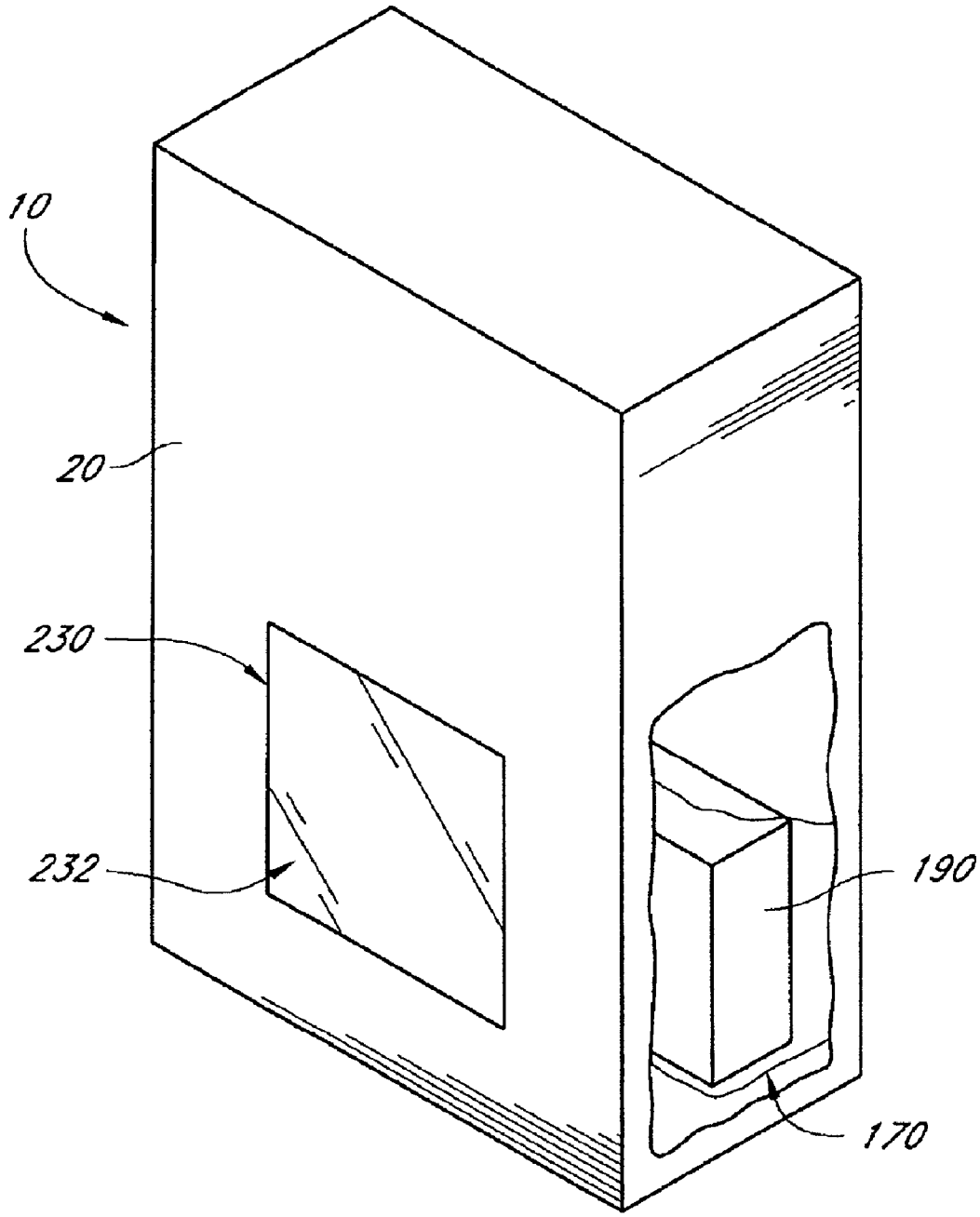
FIG. 12 is a perspective view of another modification of the packaging member having a window provided in one surface thereof.

In a further modification of the member 10, illustrated in FIG. 12, the base panel 20 can include an aperture 230 allowing for viewing of the article 190 therethrough. In such an arrangement, it is advantageous to use a retention member 170 that has a generally clear or translucent appearance, thereby allowing viewing of the article 190 through the aperture 230. In this arrangement, the base member 20 can form what would be considered a "top" of the completed container. In some embodiments, the aperture 230 can be covered with a clear or translucent panel 232 so as to prevent the intrusion of foreign objects into the cavity 162.

Although the present inventions have been described in terms of certain embodiments, other embodiments apparent to those of ordinary skill in the art also are within the scope of these inventions. Thus, various changes and modifications may be made without departing from the spirit and scope of the inventions. For instance, various components may be repositioned as desired. Moreover, not all of the features, aspects and advantages are necessarily required to practice the present inventions.

What is claimed is:

1. A method of packaging an article, comprising:

providing a resilient member comprising a body portion and first and second pockets connected to the body portion;

providing a substantially rigid member comprising:

a container forming portion comprising a plurality of foldable portions, and an article securing portion pivotably connected to the container forming portion and comprising first and second flap portions and a support portion interposed between the first and second flap portions, wherein the support portion is configured to support an article and is pivotably connected to the container forming portion;

engaging the first and second flap portions with the first and second pockets, respectively;

securing an article under tension of the resilient member;

forming a container by folding the plurality of foldable portions of the container forming portion; and pivoting the support portion with respect to the container to insert the article securing portion in the container, wherein the container receives the support portion, the first and second flap portions, the resilient member and the secured article upon inserting the article securing portion in the container.

2. The method of claim 1, wherein the support portion comprises a first surface and a second surface opposing the first surface, and wherein the body portion extends over the first surface.

3. The method of claim 2, further comprising folding the first and second flap portions toward second surface and away from the first surface so as to provide tension to the resilient member.

4. The method of claim 2, wherein the article is secured between the support portion and the body portion.

5. The method of claim 1, wherein the container comprises a bottom and a plurality of walls extending from the bottom, wherein one of the plurality of walls is pivotably connected to the support portion.

6. The method of claim 1, wherein the substantially rigid member comprises a single piece of cardboard.

7. The method of claim 1, wherein the substantially rigid member additionally comprise a lid portion pivotably connected to the container portion, wherein the method further comprises pivoting the lid portion with respect to the container portion to enclose the article securing portion, the resilient member and the secured article.

8. The method of claim 1, wherein the substantially rigid member additionally comprises a separator portion pivotably connected to the article securing portion, and wherein the method further comprises folding the separator wall so as to form a partitioning wall within the container which partitions a cavity in the container into at least two areas.

9. A packaging container for packaging an article and maintaining the article therein, the container comprising:

a resilient member comprising a body portion and first and second pockets connected to the body portion; and a frame member comprising:

a container portion comprising a bottom and a plurality of walls extending from the bottom, and an article securing portion comprising a support portion, a first pivotable portion and a second pivotable portion, the support portion being interposed between the first and second pivotable portions, wherein the article securing portion is pivotably connected to the container portion, wherein the first and the second pockets are configured to receive the first and second pivotable portions, respectively, wherein the first and second pivotable portions are configured to pivot with respect to the support portion to secure an article under tension of the resilient member, wherein the support portion is configured to support the article and pivotably connected to the container portion, wherein the container is configured to receive the support portion, the first and second pivotable portion, the resilient member and the secured article when pivoting the support portion with respect to the container portion.

10. The container of claim 9, wherein the support portion comprises a first surface and a second surface opposing the first surface, and wherein the body portion extends over the first surface.

11. The container of claim 10, wherein the first and second pivotable portions are configured to be folded toward the second surface and away from the first surface to form a folded state of the first and second pivotable portions, and wherein the resilient member holds tension in that folded state of the first and second pivotable portions.

12. The container of claim 10, wherein the article is configured to be secured between the support portion and the body portion.

13. The container of claim 9, wherein the frame member comprises a single piece of cardboard.

14. The container of claim 9, wherein the frame member additionally comprising a lid portion pivotably connected to the container portion, wherein the lid portion and the container portion are configured to enclose the article securing portion, the resilient portion and the secured article.

15. The container of claim 9, wherein the frame member additionally comprising a separator portion pivotably connected to the article securing portion, the separator portion being configured to form a partitioning wall within the container so as to partition a cavity in the container into at least two areas.

16. A packaging kit, comprising:

a substantially rigid member comprising:

a container portion comprising a plurality of foldable portions configured to form a bottom and a plurality of walls, each of the plurality of walls extending from the bottom, and an article securing portion pivotably connected to the container portion and comprising a support portion, a first pivotable portion and a second pivotable portions, the support portion comprising a first surface and a second surface opposing the first surface, the support portion being interposed between the first and second pivotable portions, the first and second pivotable portions being pivotably connected to the support portion, wherein the substantially rigid member comprises a single piece of foldable board; and a retention member comprising a body portion and first and second engaging portions connected to the body portion, the first and second engaging portions being configured to be engaged with the first and second pivotable portions, respectively, such that the body portion extends over the first surface, wherein the first and second pivotable portions are configured to be folded toward the second surface and away from the second surface so as to provide tension to the retention member, wherein the support portion is configured to support an article and pivotably connected to the container portion, wherein the container is configured to receive the support portion, the first and second pivotable portion, the retention member and the secured article when pivoting the support portion with respect to the container portion.

17. The packaging kit of claim 16, wherein the article securing portion is configured to secure an article under tension of the retention member.

* * * * *